US010717286B2

(12) United States Patent
Kudo et al.

(10) Patent No.: US 10,717,286 B2
(45) Date of Patent: Jul. 21, 2020

(54) PLUG MEMBER AND LIQUID CONTAINMENT UNIT

(71) Applicant: SEIKO EPSON CORPORATION, Tokyo (JP)

(72) Inventors: Shoma Kudo, Shiojiri (JP); Naomi Kimura, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/173,613

(22) Filed: Oct. 29, 2018

(65) Prior Publication Data

US 2019/0126629 A1 May 2, 2019

(30) Foreign Application Priority Data

Oct. 30, 2017 (JP) ..... 2017-208901

(51) Int. Cl.
*B41J 2/17* (2006.01)
*B41J 2/175* (2006.01)
*B41J 29/13* (2006.01)

(52) U.S. Cl.
CPC ..... *B41J 2/17553* (2013.01); *B41J 2/1752* (2013.01); *B41J 2/17513* (2013.01); *B41J 2/17523* (2013.01); *B41J 2/17536* (2013.01); *B41J 29/13* (2013.01)

(58) Field of Classification Search
None
See application file for complete search history.

(56) References Cited

U.S. PATENT DOCUMENTS

2015/0360476 A1* 12/2015 Osakabe ..... B41J 2/17553 347/85

FOREIGN PATENT DOCUMENTS

JP 2016-000504 A 1/2016

* cited by examiner

*Primary Examiner* — Erica S Lin
(74) *Attorney, Agent, or Firm* — Foley & Lardner LLP

(57) ABSTRACT

A plug member is a plug member for covering a liquid injection port for injecting liquid to a liquid container portion of a liquid ejecting apparatus. The plug member includes an elastically deformable plug body, and a holding member that has a higher rigidity than the plug body and is for holding the plug body. The plug body includes a lid part for covering the liquid injection port and a barrel part extending from the lid part to the liquid container portion. The barrel part includes an end portion forming an opening at a side opposite to the lid part, and the holding member includes an engaging portion engageable with a shaft portion for rotating the holding member and a support portion that is provided at an engaging portion side of the end portion and is for supporting the end portion.

7 Claims, 17 Drawing Sheets

PLUG MEMBER AND LIQUID CONTAINMENT UNIT

BACKGROUND

1. Technical Field

The present invention relates to a plug member and a liquid container unit.

2. Related Art

For example, JP-A-2016-504 discloses a liquid ejecting apparatus (liquid consumption apparatus) having a liquid ejecting portion that ejects liquid to a target such as paper. This liquid ejecting apparatus includes a liquid container unit having a tank (an example of a liquid container portion) in which ink (an example of liquid) to be supplied to the liquid ejecting portion is contained, a cap (an example of a plug member) for opening and closing an injection port of the tank, and a cover for opening and closing an opening of the space in which the tank is arranged. A holding portion for holding the cap that a user removed is provided inside the cover, in a state where the cover is at the open position. Due to the cap being located on a movement area (movement path) from the open position to the closed position of the cover in the state where the cap is held in the holding portion, the movement of the cover to the closed position is hindered. Accordingly, it is possible to prevent the user from forgetting to close the injection port with the removed cap.

JP-A-2016-504 is an example of related art.

In the liquid ejecting apparatus disclosed in JP-A-2016-504, because the user grips and removes the cap with his or her fingers, there is a problem that the ink of the cap adheres to the fingers and the user's hand is easily stained with the ink.

Accordingly, it is also conceivable to attach a cap to a holding member to which the cap can be attached so that the hand does not directly touch the cap. Note that in this case, it is necessary to adopt a configuration in which the cap is less likely to come off of the holding member.

The above problem is generally the same for a liquid container unit in which liquid to be supplied to a liquid ejecting portion is other than ink.

SUMMARY

An advantage of some aspects of the invention is to provide a plug member in which, when a user opens and closes the plug member, the frequency with which liquid on the plug member attaches to a finger or the like can be reduced, and a cap (an example of the plug member) is less likely to come off of a holding member, and to provide a liquid container unit including the plug member.

Application Example 1

A plug member according to the present application example is a plug member for covering a liquid injection port for injecting liquid to liquid container portion of a liquid ejecting apparatus, the plug member including an elastically deformable plug body, and a holding member that has a higher rigidity than the plug body and is for holding the plug body. The plug body includes a lid part for covering the liquid injection port and a barrel part extending from the lid part to the liquid container portion. The barrel part includes an end portion forming an opening at a side opposite to the lid part. The holding member includes an engaging portion engageable with a shaft portion for rotating the holding member and a support portion that is provided at an engaging portion side of the end portion and is for supporting the end portion.

With this configuration, because the end portion of the plug body is supported by the support portion, the plug body can be made less likely to come off of the holding member. In addition, because it is not required to directly hold the plug member with fingers, stain of the fingers with liquid can be suppressed.

Application Example 2

The plug member according to the above application example includes, letting the support portion be a first support portion, a second support portion for supporting the end portion, on a side opposite to the engaging portion of the end portion.

According to this configuration, the end portion of the plug member is supported by the first support portion and the second support portion. Accordingly, the plug body can be made even less likely to come off of the holding member.

Application Example 3

The liquid container unit according to the present application example includes the above plug member.

According to this configuration, a liquid container unit that a user easily handles can be provided.

DESCRIPTION OF EXEMPLARY EMBODIMENTS

Hereinafter, a multi-function printer including a liquid ejecting apparatus (e.g., a printer apparatus) will be described with reference to the drawings. Note that the liquid ejecting apparatus according to the present embodiment is constituted by an ink-jet printer that performs printing by, for example, ejecting liquid composed of ink and the like onto a medium made of paper or the like. Also, the liquid ejecting apparatus will be described using an example of a serial printer that performs printing with a printing method by moving a liquid ejecting portion in a scanning direction X (hereinafter, also referred to as a width direction X) intersecting a medium conveying direction Y.

First Embodiment

Figure 1:
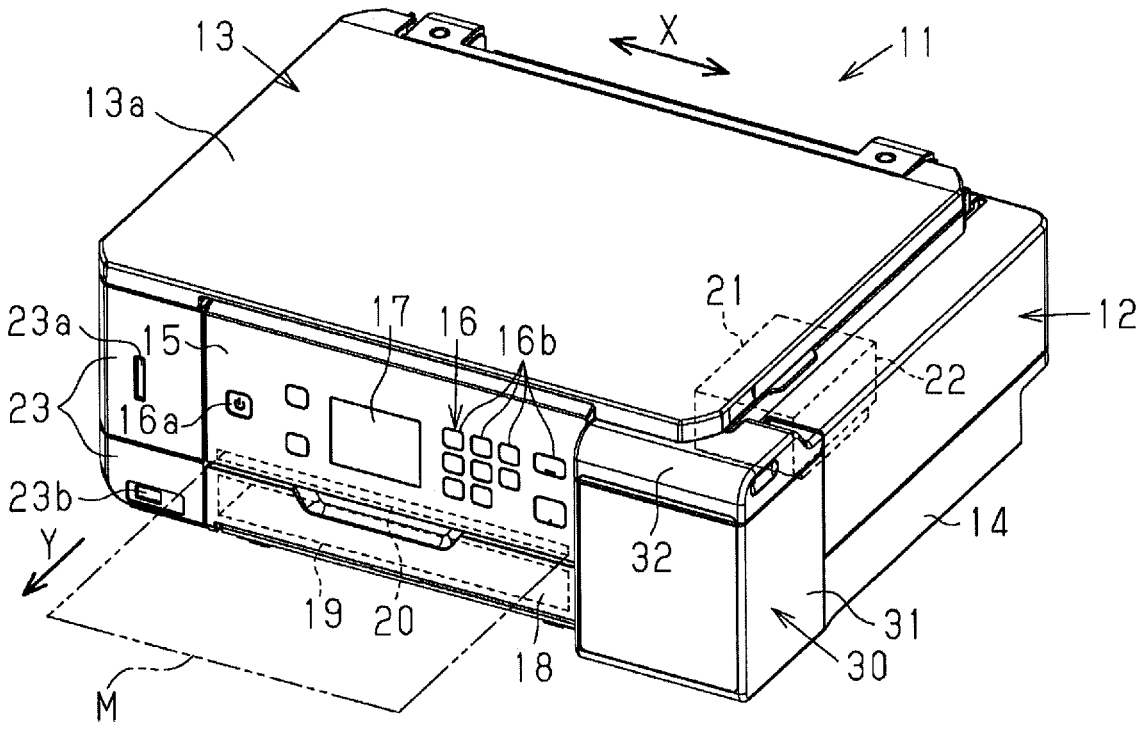
FIG. 1 is a perspective view showing a multi-function printer including a liquid ejecting apparatus according to a first embodiment.

As shown in FIG. 1, a multi-function printer 11 includes a liquid ejecting apparatus 12 for ejecting liquid and an image reading apparatus 13 having a reading function. The liquid ejecting apparatus 12 includes a casing 14 having a rectangular parallelepiped shape, and the image reading apparatus 13 is arranged on the upper side of the casing 14.

The casing 14 is provided with an operation panel portion 15. The operation panel portion 15 has, for example, an operation portion 16 including a power button 16*a* and operation buttons 16*b* and the like, and a display portion 17 constituted by a touch-panel liquid crystal display screen or the like.

Also, a medium storage cassette 19 and a discharge port 20 for discharging a medium M that has been printed on are provided on the back side of a front cover 18 provided on the lower part of the front face of the casing 14 so as to be openable and closable around the lower end. A medium M that is fed from the medium storage cassette 19 is turned over at the back side position and conveyed in a conveying direction Y along a predetermined conveying path.

As shown in FIG. 1, in the casing 14, a liquid ejecting portion 21 for ejecting liquid to a medium M that is conveyed in the conveying direction Y is provided. Printing is performed through, for example, a liquid ejecting operation in which the liquid ejecting portion 21 ejects liquid to a medium M at an intermediate position of the conveying path of the medium M, and the medium M that has been printed on is discharged from the discharge port 20 as indicated by a two-dot chain line in FIG. 1. The discharged medium M is stacked on a slide-type stacker (discharge tray) (not shown) extending forward from the casing 14 to the downstream side in the conveying direction before printing starts. In this example in which the liquid ejecting apparatus 12 is a serial printer, the liquid ejecting portion 21 includes a carriage 22 capable of moving reciprocally in a scanning direction X intersecting the conveying direction Y. The liquid ejecting portion 21 includes a nozzle (not shown) that can eject liquid to a portion opposite to the conveying path of a medium M. Note that, in an example in which the liquid ejecting apparatus 12 is a line printer, the liquid ejecting portion 21 has an elongated shape with a length according to which it is possible to eject liquid all at once onto the entire region of a target liquid ejection region across the width direction X intersecting the conveying direction Y.

As shown in FIG. 1, the liquid ejecting apparatus 12 includes a liquid container unit 30 for supplying liquid to the liquid ejecting portion 21. In this example, the liquid container unit 30 is arranged at one of the two end portions in the width direction X of the casing 14. A communication portion 23 having communication connection portions 23*a* and 23*b* is arranged at one (the other) of the two end portions in the width direction X of the casing 14, and the liquid container unit 30 is arranged at one end portion opposite to the communication portion 23 in the width direction X. In the example shown in FIG. 1, the liquid container unit 30 is in a state where its side is covered by a case portion 31 constituting a part of the casing 14 (the exterior of the apparatus), and includes, on its upper side, a cover 32 covering the upper opening of the case portion 31. Note that the details of the liquid container unit 30 will be described later.

The image reading apparatus 13 shown in FIG. 1 includes a document cover 13*a* that is openable and closable and is located above the image reading device 13, and an image scanner (not shown) capable of reading an image of a document placed on a document platform made of a glass plate (not shown) covered with the document cover 13*a* in a closed state, from below the glass plate. The image reading apparatus 13 is openable and closable to a closed position shown in FIG. 1 and an open position shown in FIG. 2, with respect to the casing 14. When maintenance is to be performed on the inside of the liquid ejecting apparatus 12, for example, in order to eliminate a medium jam or the like, the image reading apparatus 13 is moved from the closed position to the open position to bring the interior of the casing 14 into an exposed state. Also, the cover 32 is opened, for example, when liquid is supplied in the liquid container unit 30, but in the liquid ejecting apparatus 12 of this example, the image reading apparatus 13 at the closed position exists on the movement path between the open position and the closed position of the cover 32. Accordingly, the cover 32 is moved from the closed position shown in FIG. 1 to the open position shown in FIG. 2, in the state in which the image reading apparatus 13 is arranged at the open position. Note that, in FIG. 2, for convenience of explanation, the liquid ejecting portion 21 that is arranged at a stand-by position shown in FIG. 1 when the image reading apparatus 13 is arranged at the open position is arranged at an intermediate position on its moving path. Alternatively, the cover 32 may be omitted, and a configuration in which a part of the image reading apparatus 13 covers the upper opening of the liquid container unit 30, or a configuration in which the upper opening of the liquid container unit 30 is in an open state may also be adopted.

Figure 2:
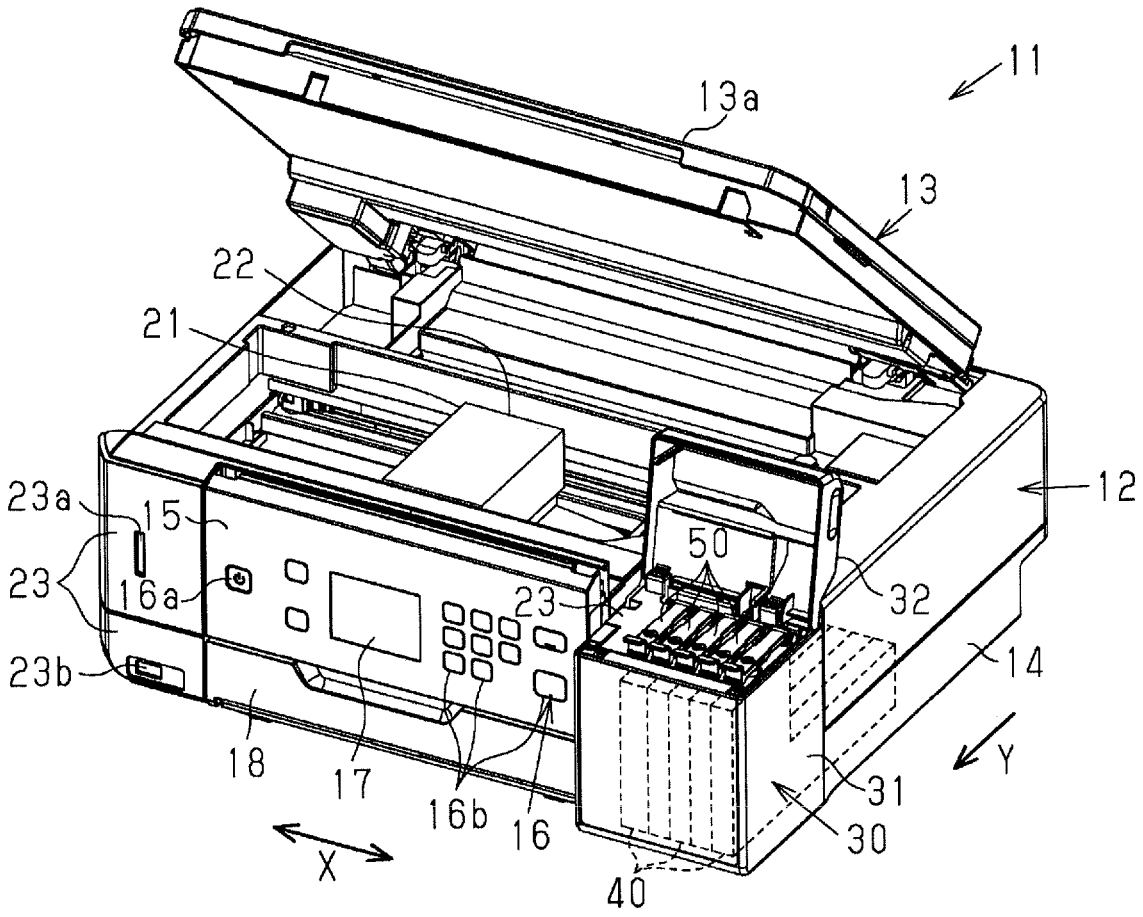
FIG. 2 is a perspective view showing the multi-function printer in a state where an image reading apparatus and a cover are open.

As shown in FIG. 2, when the cover 32 of the liquid container unit 30 is opened from the closed position to an open position with an opening angle within a range of, for example, 90 to 170 degrees, further movement of the cover 32 in the opening direction is restricted. The liquid container unit 30 includes a liquid container portion 40 for containing liquid. Inside of the case portion 31, the same number of liquid container portions 40 as the number of types of liquids that the liquid ejecting portion 21 can eject are provided. Because the liquid ejecting portion 21 of this example can eject several types of liquids, multiple liquid container portions 40 are provided in the liquid container unit 30 so as to be able to supply these several types of liquids.

Also, the liquid container unit 30 includes a plug member 50 for opening and closing an injection port 43 (refer to FIG. 5) serving as a liquid injection port of the liquid container portion 40. In this example, the plug member 50 is individually provided in the multiple liquid container portions 40 arranged in a housing 33. A user individually opens the plug member 50 corresponding to the liquid container portion 40 to be injected with liquid, and injects liquid from a liquid bottle (not shown) to the liquid container portion 40. Note that the liquid container unit 30 is not limited to a configuration in which the liquid container unit 30 is arranged in a part of the casing 14 shown in FIGS. 1 and 2, a configuration in which the liquid container unit 30 is installed at the outer wall of the casing 14 (e.g., side wall portion), or a configuration in which the liquid container unit 30 is provided separately from the casing 14, and is connected to the casing 14 via liquid supplying tubes, may also be adopted. In other words, the liquid container unit 30 may be arranged inside or outside of the casing 14, as long as liquid can be supplied to the liquid ejecting portion 21 from the liquid container unit 30 via a liquid supplying path.

Figure 3:
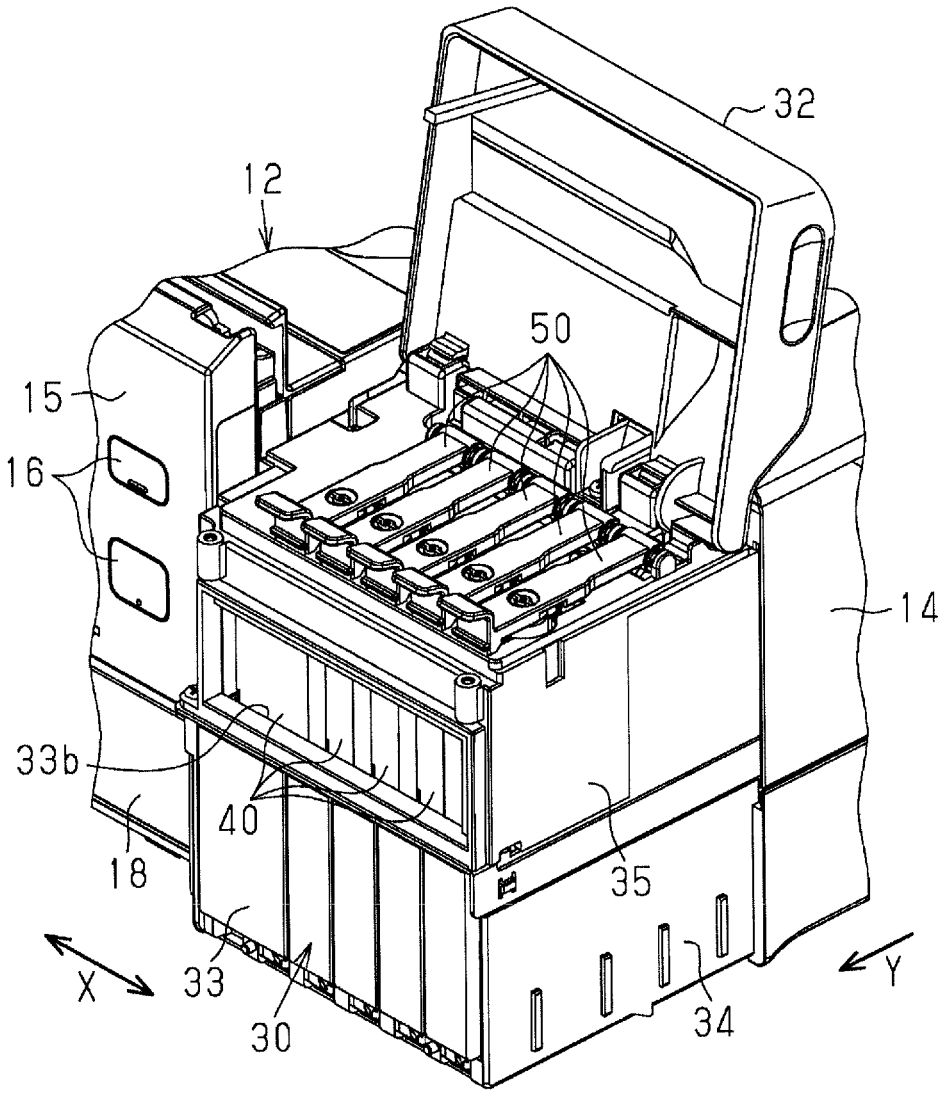
FIG. 3 is a perspective view showing a liquid container unit in a state where the cover is open.

Next, a detailed configuration of the liquid container unit will be described with reference to FIGS. 3 to 5. FIG. 3 shows a state in which the case portion 31 is removed from the casing 14 and a state in which the cover 32 is open. As shown in FIG. 3, the liquid container unit 30 includes the housing 33 for arranging the liquid container portions 40. The multiple liquid container portions 40 are arranged in the housing 33. Multiple plug members 50 are rotatably supported by the upper surface portion of the housing 33 at positions corresponding to each of the multiple liquid container portions 40.

Figure 5:
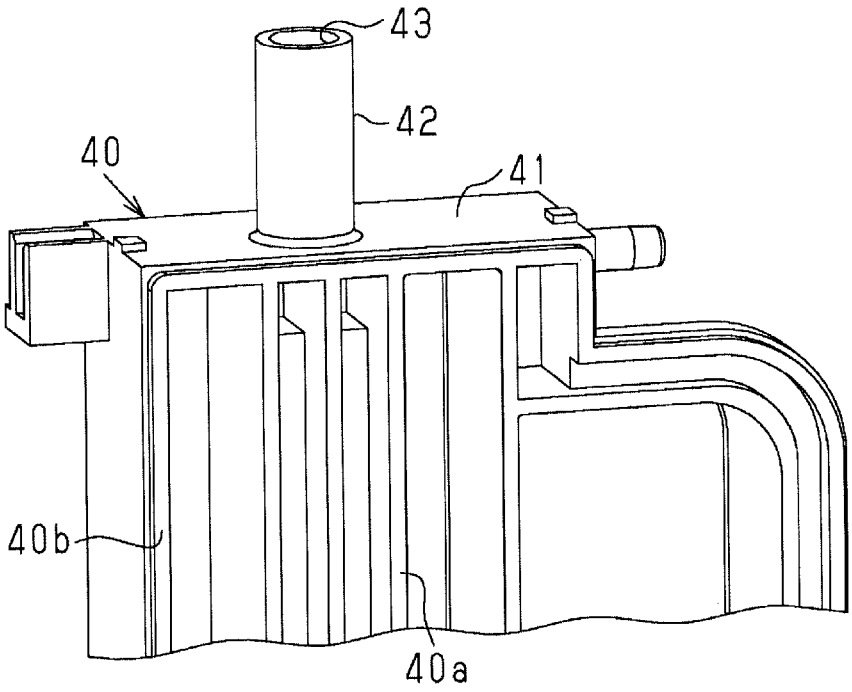
FIG. 5 is a partial perspective view showing a liquid container portion.
Figure 6:
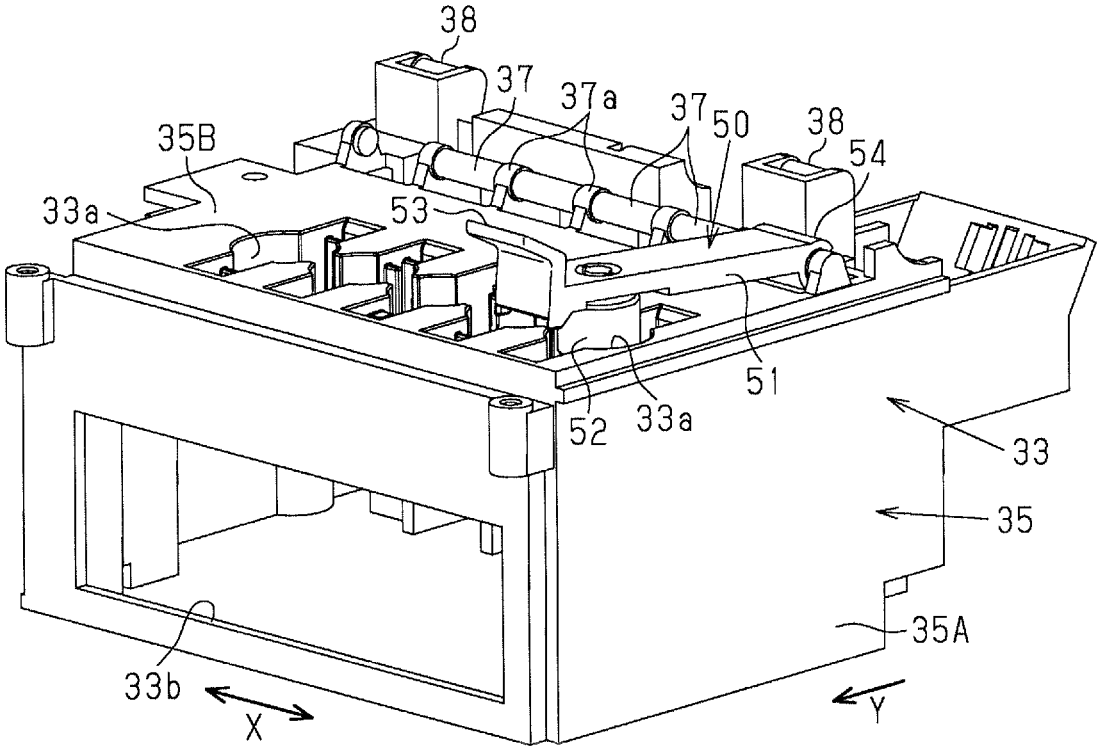
FIG. 6 is a perspective view showing a part of a housing to which a plug member is attached.

In addition, as shown in FIG. 3, the housing 33 has a bottomed cylindrical lower housing 34 and a cylindrical upper housing 35. Note that FIG. 4 shows the liquid container unit 30 in a state where the upper housing 35 is removed, FIG. 5 shows the upper portion of the liquid container portion 40, and the FIG. 6 shows the upper housing 35 and the plug member 50.

Figure 4:
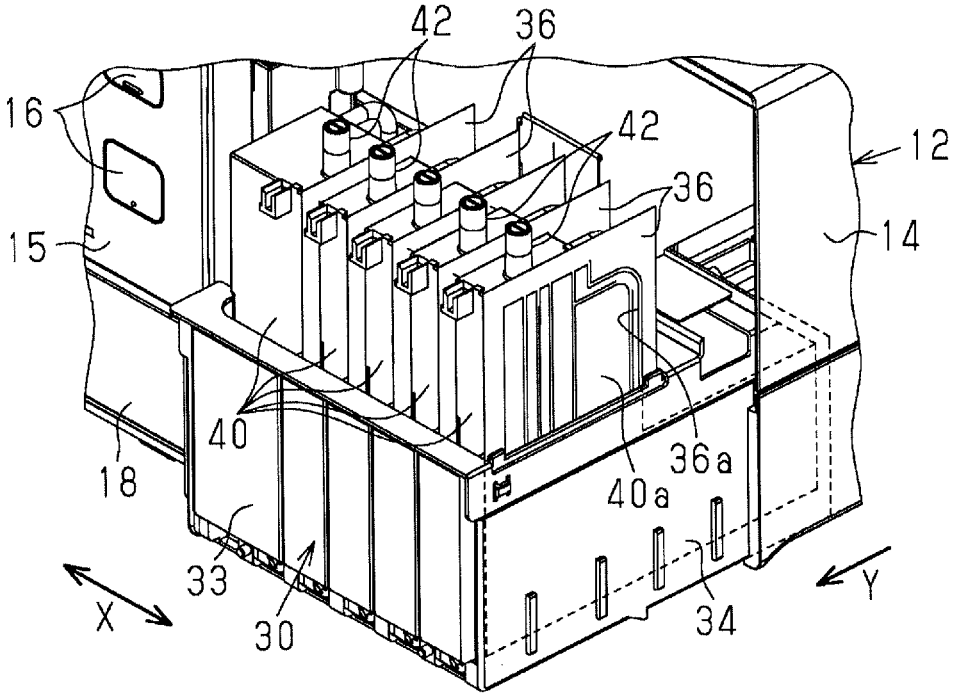
FIG. 4 is a perspective view showing the liquid container unit in a state where an upper housing is removed.

As shown in FIG. 4, the lower housing 34 includes multiple division plates 36 for dividing the arrangement region of the multiple liquid container portions 40. The multiple liquid container portions 40 are accommodated in the respective arrangement regions that are divided by the division plates 36 in the width direction X. The liquid container portion 40 is positioned in the front-back direction and the vertical direction within the housing 33, due to at least a part of its side portion 40*a*, for example, a periphery portion 40*b* shown in FIG. 5, being fit into an opening 36*a* of the division plate 36.

As shown in FIGS. 3 and 4, in the liquid container portions 40 of this example, the liquid container portions 40 having different sizes (capacities) are used together. In the liquid ejecting apparatus 12, for example, in the first liquid ejection mode, the liquid ejecting portion 21 ejects liquid (the first kind of liquid) that is supplied from one liquid container portion 40, and in the second liquid ejection mode, the liquid ejecting portion 21 ejects liquid (the second kind of liquid) that is supplied from the multiple liquid container portions 40. For this reason, the liquid container portion 40 that contains the first kind of liquid has a relatively large capacity, and the liquid container portions 40 that contain the second kind of liquid have a relatively small capacity. Note that in an example in which a liquid ejecting operation is a printing operation, the first ejecting mode corresponds to a grey scale printing mode, and the second ejecting mode corresponds to a color printing mode. For example, the liquid container portion 40 that contains black ink is wider than the other multiple liquid container portions 40.

In the example shown in FIG. 4, the multiple plug members 50 are arranged at substantially equal intervals in the width direction X due to the liquid container portion 40 with the maximum capacity being arranged at the end portion position in the arrangement direction (width direction X) and the position of the cylindrical portion 42 of the liquid container portion 40 with the maximum capacity being biased toward the arrangement position side of the other liquid container portions 40 in the width direction X. Note that the sizes (capacities) of the multiple liquid container portions 40 may be the same or different, in the case of different, the combination of the sizes may be appropriately changed.

Also, as shown in FIG. 4, in the liquid container portion 40, for example, the lower portion extends longer in the depth direction than the upper portion. Accordingly, in the liquid container unit 30, a relatively large capacity of the liquid container portions 40 is ensured away from the arrangement area of the image reading apparatus 13 and the like. As shown in FIGS. 4 and 5, the liquid container portion 40 includes a container body 41, and a cylindrical portion 42 for liquid ejection protruding from one of the upper surface and the side surface (upper surface in the example of FIGS. 4 and 5), in a direction intersecting that surface. As shown in FIG. 5, the liquid container portion 40 includes an injection port 43 for injecting liquid to the liquid container portion 40. In the example of FIG. 5, the leading end opening of the cylindrical portion 42 is the injection port 43. Also, at least a part of the front surface portion of the liquid container portion 40 is a transparent portion (not shown) through which the height of the liquid surface inside can be seen from the outside. Note that the shape of the liquid container portion 40 is not limited to a shape in which the lower portion of the container body 41 is longer than the upper portion, and may be a shape in which a part in the width direction has a different height from other parts, or may be a rectangular parallelepiped shape, another quadrangular prism shape, a triangular pillar shape, or an elliptical cylinder shape.

As shown in FIG. 6, the upper housing 35 has a cylindrical housing 35A with a quadrangular cylindrical shape, and a substantially plate-like lid portion 35B for covering at least a part of the upper opening of the cylindrical housing 35A. The multiple plug members 50 are attached at the upper surface of the lid portion 35B of the housing 33 (specifically, the upper housing 35). Specifically, multiple shaft portions 37 are provided at the end portion on the depth direction side of the upper surface of the housing 33. Each shaft portion 37 is installed in a state of being horizontally extended in the width direction X of the liquid container portion 40, with both sides in the axial direction sandwiched between support portions 37*a* having a larger diameter portion than the shaft portions 37. As shown in FIG. 6, the plug member 50 has one holding member 51 and one plug body 52 for the corresponding liquid container portion 40. Recessed portions 33*a*, having sizes according to which the plug bodies 52 can be inserted therein, are formed at the upper surface of the housing 33 shown in FIG. 6. Note that in a state where the upper housing 35 is assembled on the lower housing 34 in which the multiple liquid container portions 40 are arranged, the cylindrical portion 42 of the liquid container portion 40 penetrates a circular hole (not shown) formed at the bottom of the recessed portion 33*a* and projects upward.

Also, as shown in FIG. 6, a window portion 33*b* having a width extending over the multiple liquid container portions 40 and a predetermined height is provided in the front surface portion of the housing 33. The case portion 31 has a transparent window portion (not shown) at a portion opposite to the window portion 33*b*. Accordingly, a user can visually check the height of the liquid surface (liquid level) in the liquid container portion 40 through the transparent window portion of the case portion 31 and the window portion 33*b*. In addition, as shown in FIG. 6, a pair of hinge portions 38 connected to the cover 32 are protrusively provided at the end portion in the depth direction of the housing 33.

Figure 7:
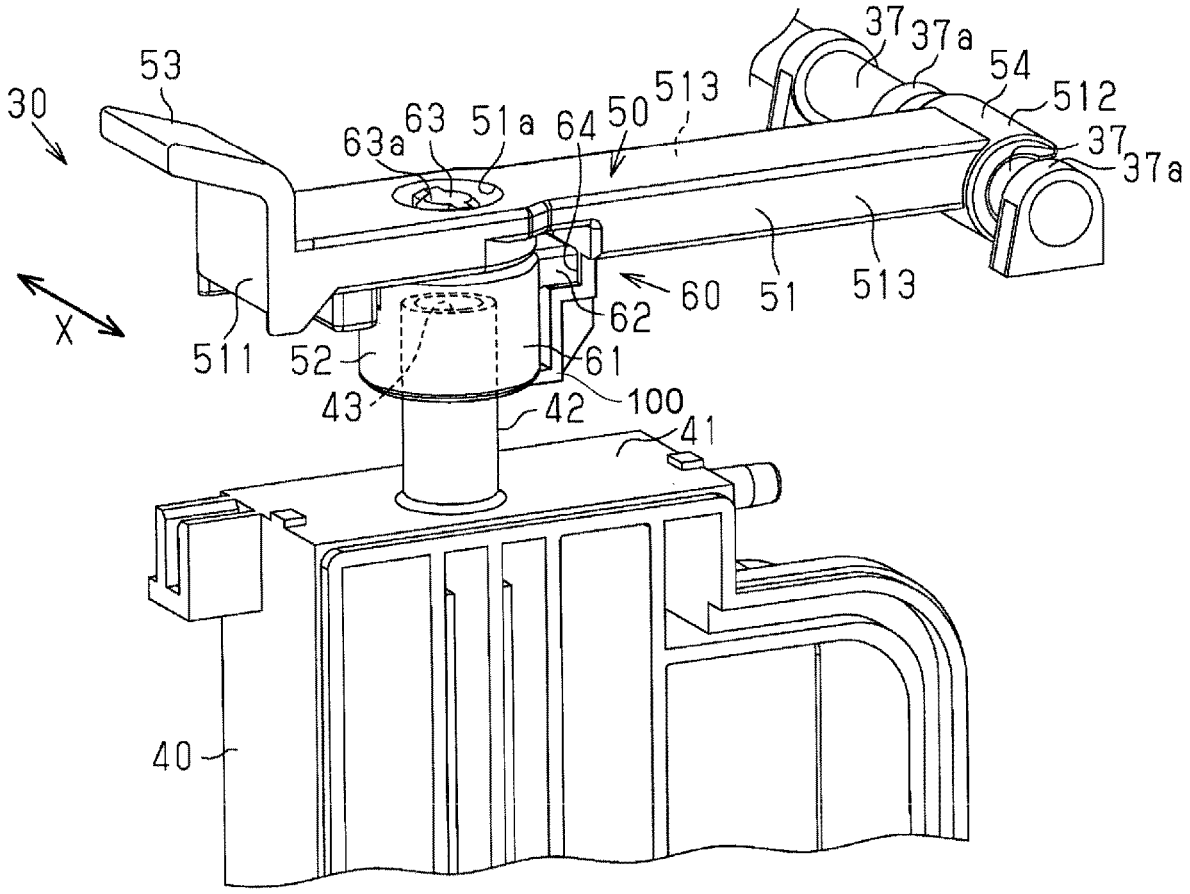
FIG. 7 is a perspective view of a relevant portion showing the liquid container portion and the plug member.

As shown in FIGS. 6 and 7, the plug member 50 has the aforementioned elastically deformable plug body 52 covering the injection port 43 (refer to FIG. 5), and the holding member 51 holding the plug body 52. The holding member 51 has a long shape that is long in one direction. As shown in FIG. 7, the holding member 51 includes one end 511, another end 512, and a side end 513 intersecting the one end 511 and the other end 512. In the examples of FIGS. 6 and 7, the holding member 51 has a substantially rectangular plate shape that is long in one direction, and has the one end 511, the other end 512, and two side ends 513 having end surfaces intersecting both end surfaces of the one end 511 and the other end 512.

As shown in FIG. 7, a gripping portion 53 that is gripped by a user is provided at the one end 511 of the holding member 51. The gripping portion 53 extends in a direction (forward direction) from the other end 512 to the one end 511 of the holding member 51, and in a direction (upward direction in FIG. 7) from the surface of the holding member 51 on the plug body 52 side (back surface) to the surface on the opposite side (outer surface). The gripping portion 53 shown in FIG. 7 extends, as an example, in an L shape in a side cross-sectional view. Also, an engaging portion 54 capable of engaging with the shaft portion 37 is provided at the other end 512 of the holding member 51. The width of the engaging portion 54 is slightly shorter than the shaft length of the shaft portion 37. In addition, the engaging portion 54 has a C-shaped cross section obtained by cutting part of a ring, and engages with the shaft portion 37 when the opening of the engaging portion 54 is pressed against the shaft portion 37.

As shown in FIG. 7, the both sides in the axial direction of the engaging portion 54 are sandwiched between the pair of support portions 37*a* in a state where the engaging portion 54 is engaged with the shaft portion 37, and thus displacement of the plug member 50 in the width direction X is restricted. Accordingly, the plug body 52 is positioned in the width direction X with respect to the cylindrical portion 42 when the plug member 50 is moved from the open position to the closed position. Note that in FIG. 7, although there are gaps between the support portions 37*a* and the engaging portion 54 for convenience of explanation, the actual gaps are extremely small, or displacement of the plug member 50 in the width direction is restricted due to an axial deviation preventing portion (not shown) that protrudes in the axial direction from at least one of the support portion 37*a* and the engaging portion 54 being interposed between them. This also applies to other embodiments.

As shown in FIG. 7, in the holding member 51, the plug body 52 is arranged at a position between the gripping portion 53 at the one end and the engaging portion 54 at the other end. Because a user can open and close the plug member 50 by gripping the gripping portion 53 located on the one end side of the holding member 51 with respect to the plug body 52 with his or her fingers, liquid in the plug body 52 is less likely to adhere to the fingers. Note that the plug member 50 is arranged in such an orientation that the longitudinal direction of the holding member 51 coincides with the longitudinal direction (depth direction) of the surface of the liquid container portion 40 on which the injection port 43 (cylindrical portion 42) is provided.

The holding member 51 shown in FIGS. 6 and 7 has a higher rigidity than the plug body 52. The holding member 51 is made of a non-flexible member, and the plug body 52 is made of a flexible member. Examples of a material of a non-flexible member include plastic, metal, and the like. Also, examples of a material of a flexible member include rubber, elastomer, and the like. The shaft portion 37, the housing 33, and the liquid container portion 40 are made of a non-flexible member. For the material of the liquid container portion 40, it is preferable that a material is selected, which is compatible with the characteristics of contained liquid (e.g., ink) and demonstrates a function required as the liquid container portion 40. Note that the materials of the holding member 51, the shaft portion 37, and the housing 33 may be the same or different.

Various connecting structures can be used for connecting the plug body 52 to the holding member 51 shown in FIG. 7, and a connection mechanism 60 is adopted in consideration of ease of assembly in this example. As shown in FIGS. 7, 8, 9, and 10, the holding member 51 has a through hole 51*a* at a connection point of the plug body 52. In this example, at least a part of the plug body 52 is fit into the through hole 51*a*.

The plug body 52 includes a lid part 57 for covering the injection port 43 and a plug portion 61 serving as a barrel part extending from the lid part 57 to the liquid container portion 40. The plug portion 61 has a bottomed cylindrical shape. Also, the plug portion 61 has a pair of protruding portions 62 (key portions) protruding on both sides in the radial direction of the plug portion 61, and a fitting portion 63 protruding in the axial direction (in the upward direction in FIGS. 7 to 10) from a portion opposite to an opening 68 of the plug portion 61. Furthermore, the fitting portion 63 includes a protrusion-like retaining portion 63*a* at its leading end portion.

A pair of groove portions 64 (key groove portions) in which the pair of protruding portions 62 can be put (inserted) are provided in the periphery of the through hole 51*a* on underside surface of the holding member 51. The pair of groove portions 64 extend in an arc shape concentric with the through hole 51*a*, and have groove paths in which one end is open and the other end is closed. The connection mechanism 60 has a locking portion (not shown) for locking the pair of protruding portions 62 and the pair of groove portions 64, when the pair of protruding portions 62 are completely inserted into the pair of groove portions 64. Due to the protruding portions 62 being inserted into the groove portions 64, the plug body 52 can be made less likely to come off of the holding member 51 when the plug member 50 is rotated to remove the plug body 52 from the injection port 43.

Furthermore, in the present embodiment, the plug member 50 includes a support portion 100. The support portion 100 is formed in the holding member 51. The support portion 100 is a portion for supporting an end portion 69 at which the opening 68 of the plug portion 61 is formed.

The support portion 100 of the present embodiment is provided on the engaging portion 54 side of the end portion 69. The support portion 100 has a substantially flat support surface 110 and supports the end portion 69 of the plug portion 61 by coming into contact with the end portion 69 of the plug portion 61 on the support surface 110. Accordingly, the plug body 52 can be made even less likely to come off of the holding member 51, when the plug member 50 is rotated to remove the plug body 52 from the injection port 43.

Figure 8:
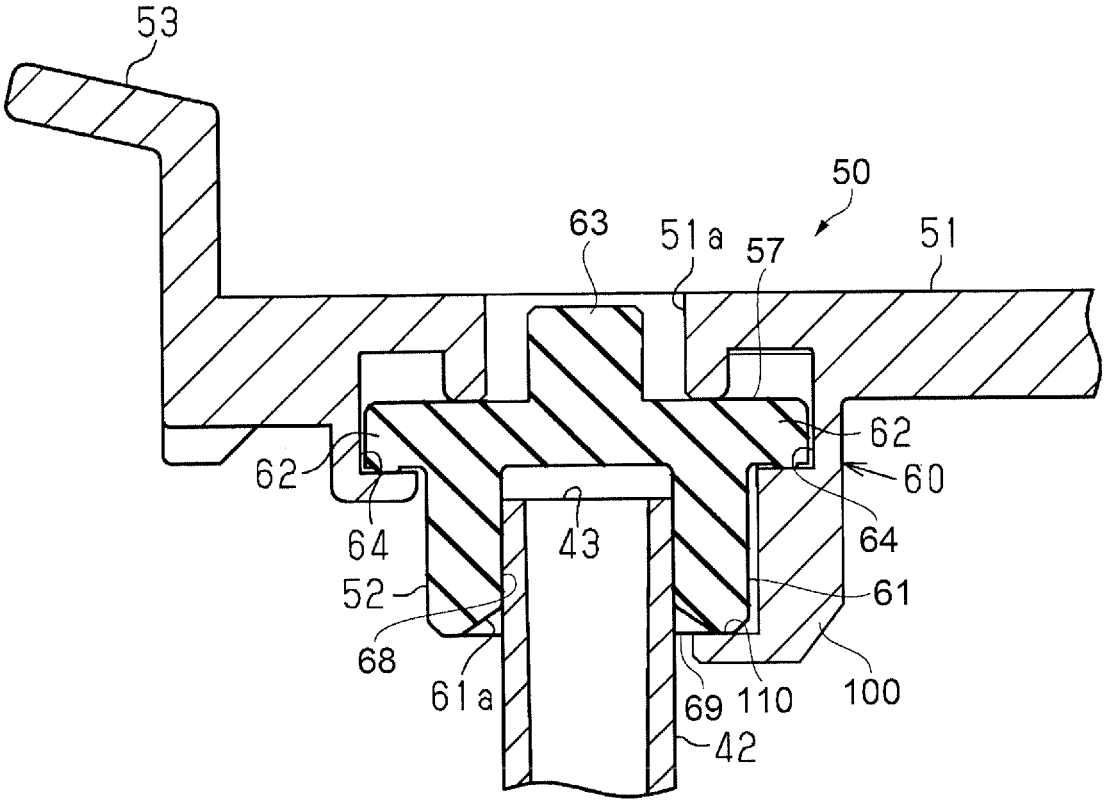
FIG. 8 is a partial cross-sectional view showing the plug member in a state where an injection port is sealed.
Figure 9:
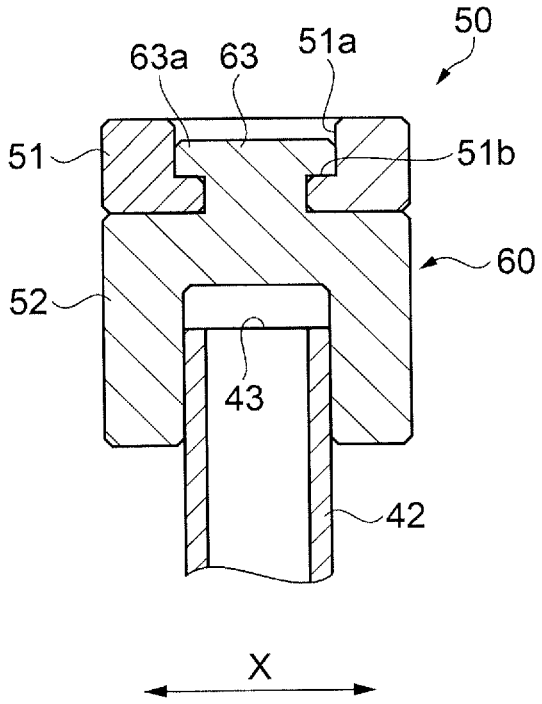
FIG. 9 is a partial cross-sectional view showing the plug member in the state where the injection port is sealed.
Figure 10:
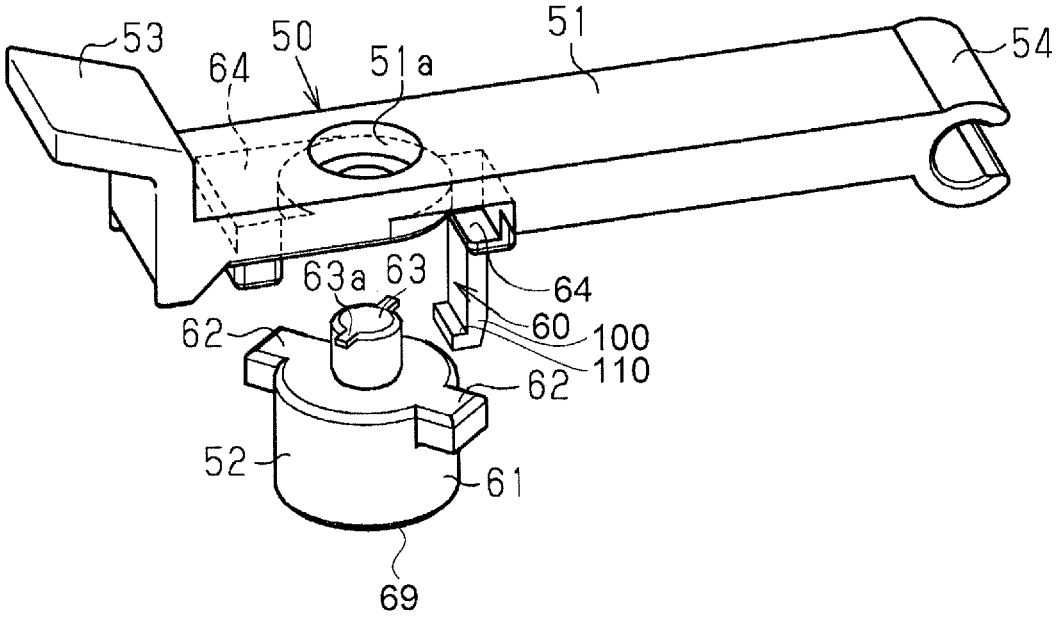
FIG. 10 is a perspective view illustrating a connecting structure of a holding member and a plug body.
Figure 11:
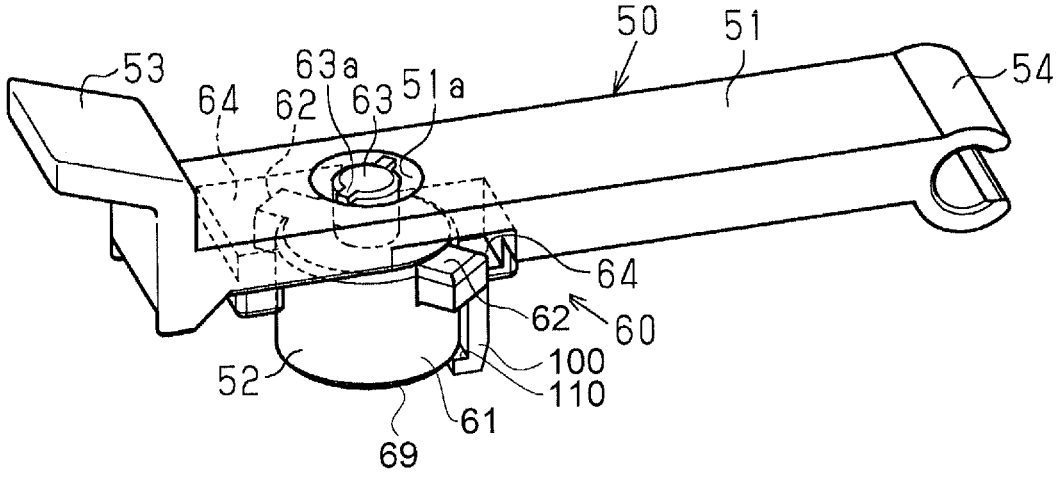
FIG. 11 is a perspective view illustrating the connecting structure of the holding member and the plug body.
Figure 12:
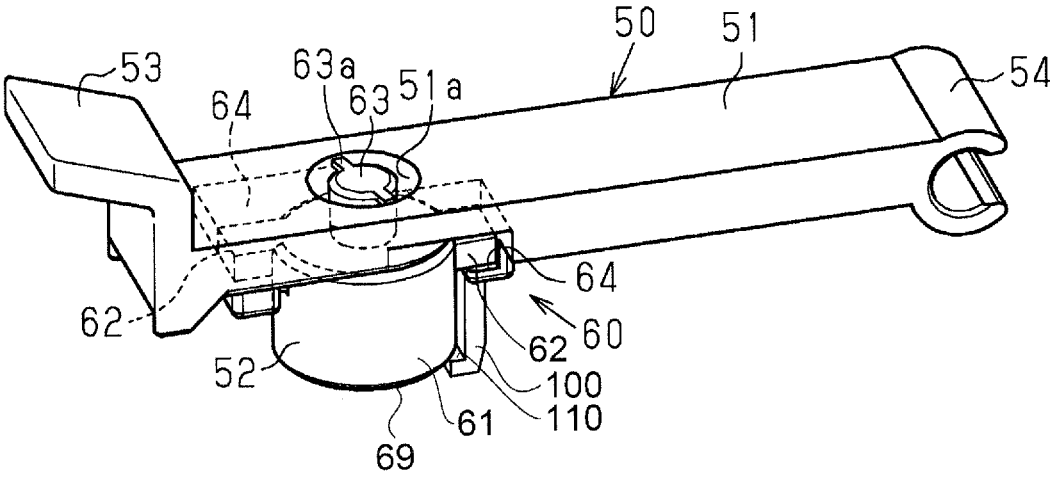
FIG. 12 is a perspective view illustrating the connecting structure of the holding member and the plug body.

Next, an assembling method for connecting the plug body 52 to the holding member 51 will be described with reference to FIGS. 10 to 12. First, as shown in FIG. 10, the fitting portion 63 of the plug body 52 is fit into the through hole 51*a* of the holding member 51, in a state where the pair of protruding portions 62 are shifted in the axial rotation direction with respect to the pair of groove portions 64. As a result, as shown in FIG. 11, the plug body 52 is temporarily connected to the holding member 51 in a state where the plug main body 52 is retained in the through hole 51*a* by the retaining portion 63*a* and the base portion of the fitting portion 63 is loosely fit in the through hole 51*a*. Next, the pair of protruding portions 62 are inserted into the pair of groove portions 64, by rotating the plug body 52 in the counterclockwise direction. Then, as shown in FIG. 12, when the pair of protruding portions 62 are inserted to the terminal ends of the pair of groove portions 64, they are locked with each other. In this manner, as shown in FIG. 9, the retaining portion 63*a* is held in a protruding portion 51*b* that is formed in the through hole 51*a*. Also, as shown in FIGS. 8 and 12, the plug body 52 is fixed with respect to the holding member 51 by the locking of the key and the key groove. Furthermore, the end portion 69 of the plug portion 61 is supported by the support surface 110 of the support portion 100.

As shown in FIG. 8, the plug body 52 seals the injection port 43 in a liquid-tight state due to the plug portion 61 being fit onto the cylindrical portion 42. The plug portion 61 includes, at the leading end portion, a guide surface 61*a* having the same inner peripheral surface shape as the peripheral surface of the truncated cone expanding toward the leading end side. Accordingly, even if the axial line of the plug body 52 is slightly shifted with respect to that of the cylindrical portion 42, the plug body 52 moves in a direction in which the axial misalignment thereof is reduced due to the guide surface 61*a*, which is in contact with the cylindrical portion 42, being guided along the cylindrical portion 42, and the plug portion 61, which is positioned by that movement, is fit into the cylindrical portion 42, and thus the injection port 43 is sealed.

Note that in the examples shown in FIGS. 7 to 12, a part of the plug body 52 (e.g., fitting portion 63) is exposed from the opening of the through hole 51*a* in the surface of the holding member 51. Accordingly, as shown in FIGS. 13 to 16, it is possible to adopt a covering member 65 (a cap 66) that holds the exposed fitting portion 63 (the retaining portion 63*a*) in the through hole 51*a* by grasping it.

Figure 13:
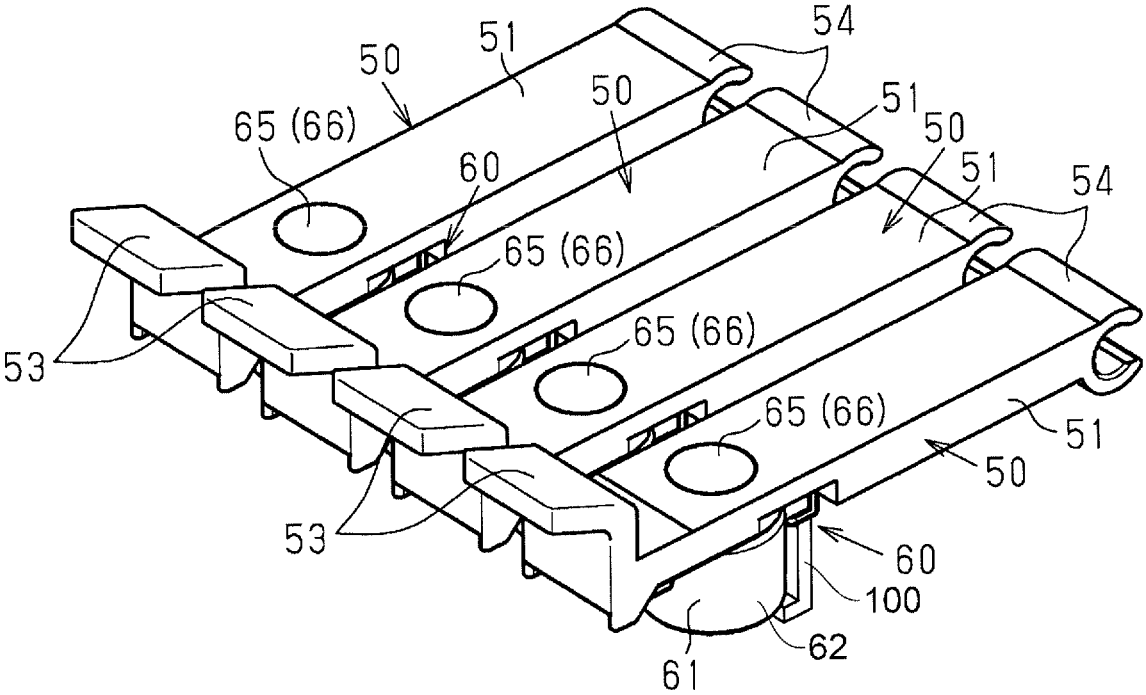
FIG. 13 is a perspective view showing multiple plug members to which covering members are attached.

In the example shown in FIG. 13, an opening (hereinafter, also referred to as "opening on the upper side") opposite to the plug body 52 side of the through hole 51*a* in the holding member 51 is covered with the covering member 65. The covering member 65 is provided corresponding to the kind of the liquid contained in the liquid container portion 40, and in this example, is provided corresponding to the color of the liquid. That is, at least a part of the surface (outer surface) of the covering member 65 on the side opposite to the surface facing the through hole 51*a* indicates the type of the liquid, and in this example, indicates the color of the liquid contained in the liquid container portion 40 closed by the plug member 50 provided with that covering member 65. Here, "indicating the color" means that a part or the whole of the covering member 65 may be colored with the color of the liquid, information indicating the color (e.g., color name or part number (model number), etc.) may be written on the covering member 65, or both of the coloration and the writing of the information indicating the color may be adopted.

Figure 14:
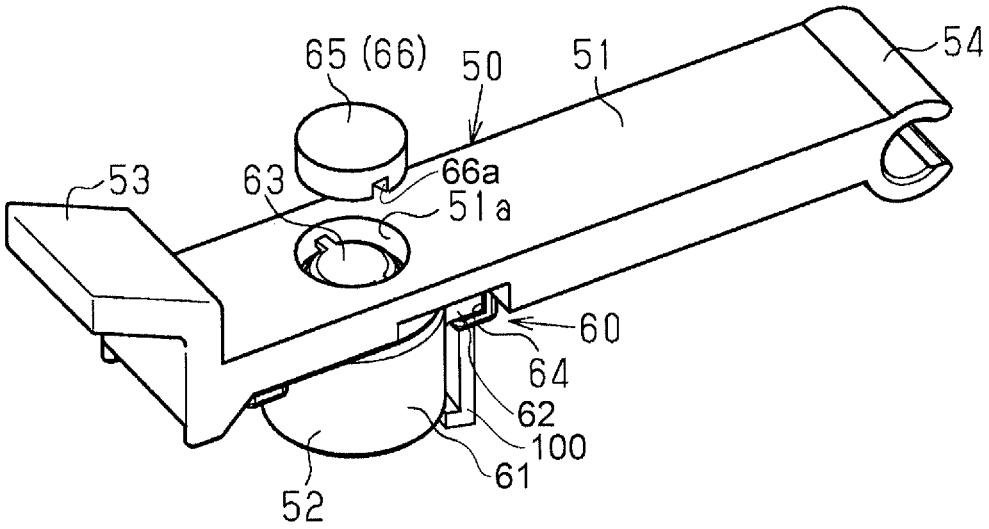
FIG. 14 is an exploded perspective view showing an attachment structure of the covering member.
Figure 15:
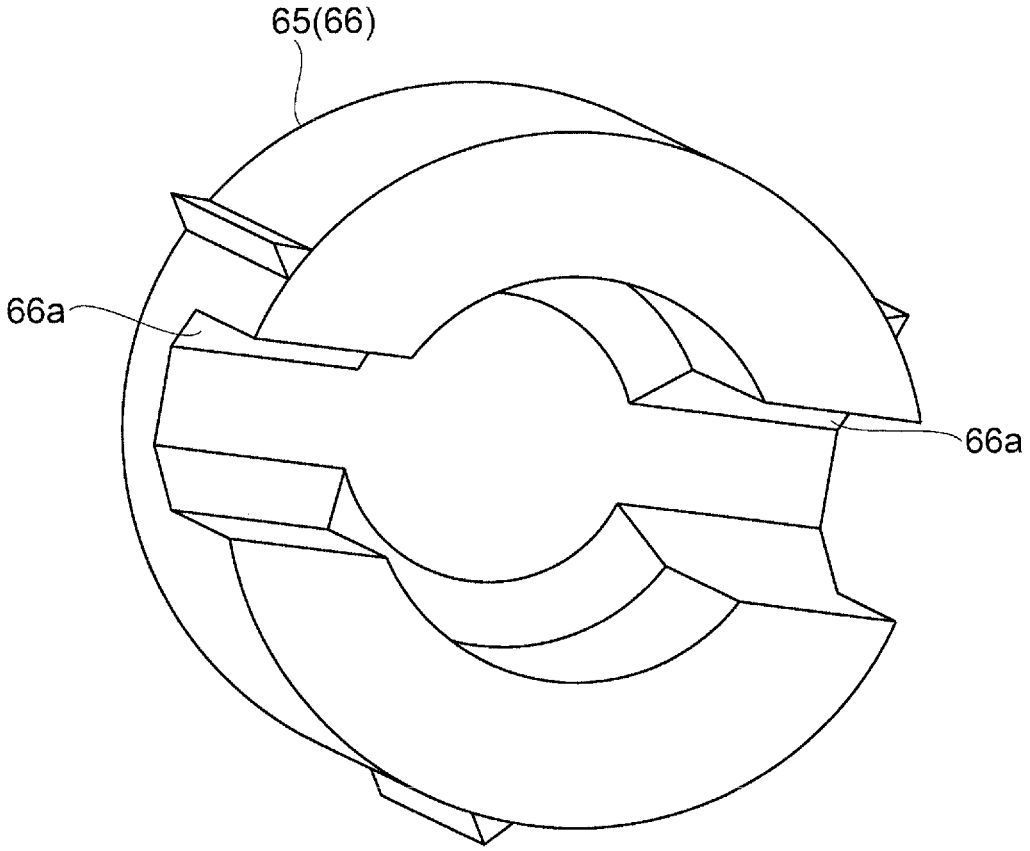
FIG. 15 is a perspective view showing a configuration of the covering member.

In the examples shown in FIGS. 14 and 15, the covering member 65 is constituted by the cap 66, which has a shape that can be fit from the upper side opening of the through hole 51*a*. Specifically, a groove portion 66*a* corresponding to the fitting portion 63 and the retaining portion 63*a* of the plug body 52 is formed in the cap 66. Also, for example, the cap 66 is colored with the same color as the color of the liquid contained in the corresponding liquid container portion 40. The opening is covered with the cap 66, due to the cap 66 being fit from the upper side opening of the through hole 51*a*. Accordingly, as shown in FIG. 13, even if the multiple plug members 50 are arranged side by side, a user can recognize the color of liquid from the color indicated by the cap 66, that is, at least one of the coloration and the writing of the information indicating the color, and thus the user is less likely to mistake the type (color) of liquid to be injected into the liquid container portion 40.

Figure 16:
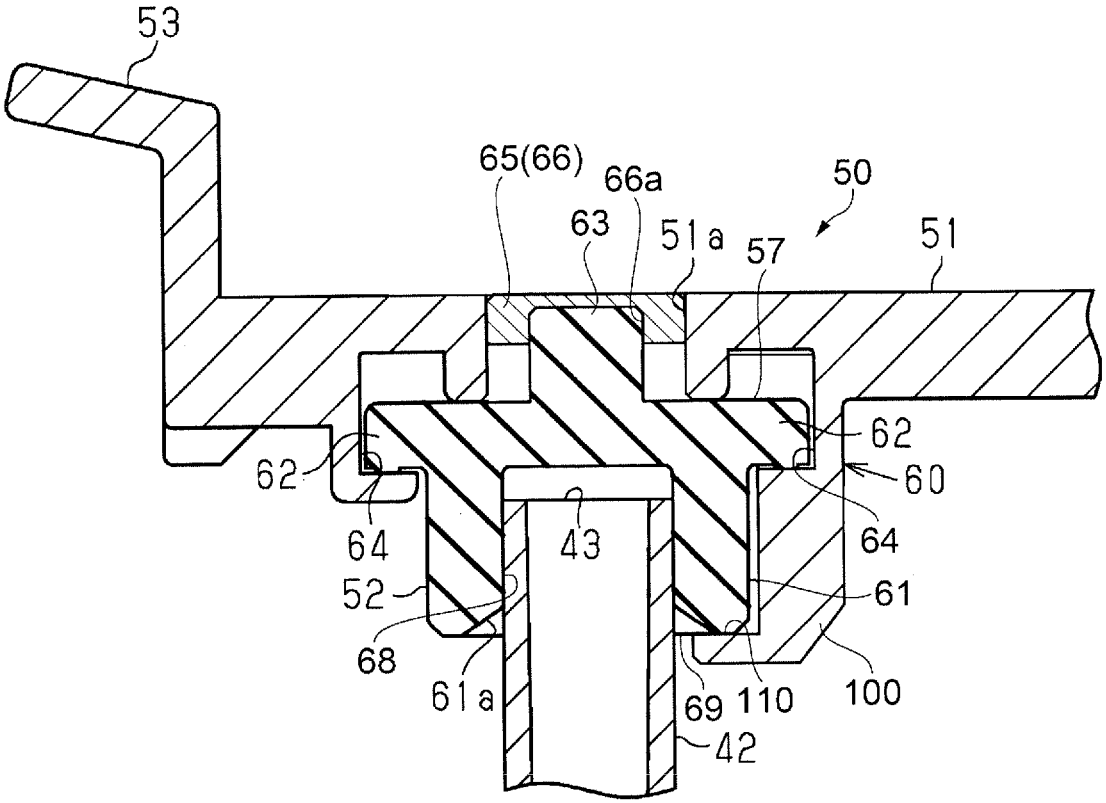
FIG. 16 is a partial cross-sectional view showing the plug member to which the covering member is attached.

Also, as shown in FIG. 16, the groove portion 66*a* of the cap 66 comes into contact with the fitting portion 63 and the retaining portion 63*a*. That is, the groove portion 66*a* of the cap 66 can hold the fitting portion 63 and the retaining portion 63*a* by grasping them. Accordingly, the plug body 52 can be made even less likely to come off of the holding member 51.

Figure 17:
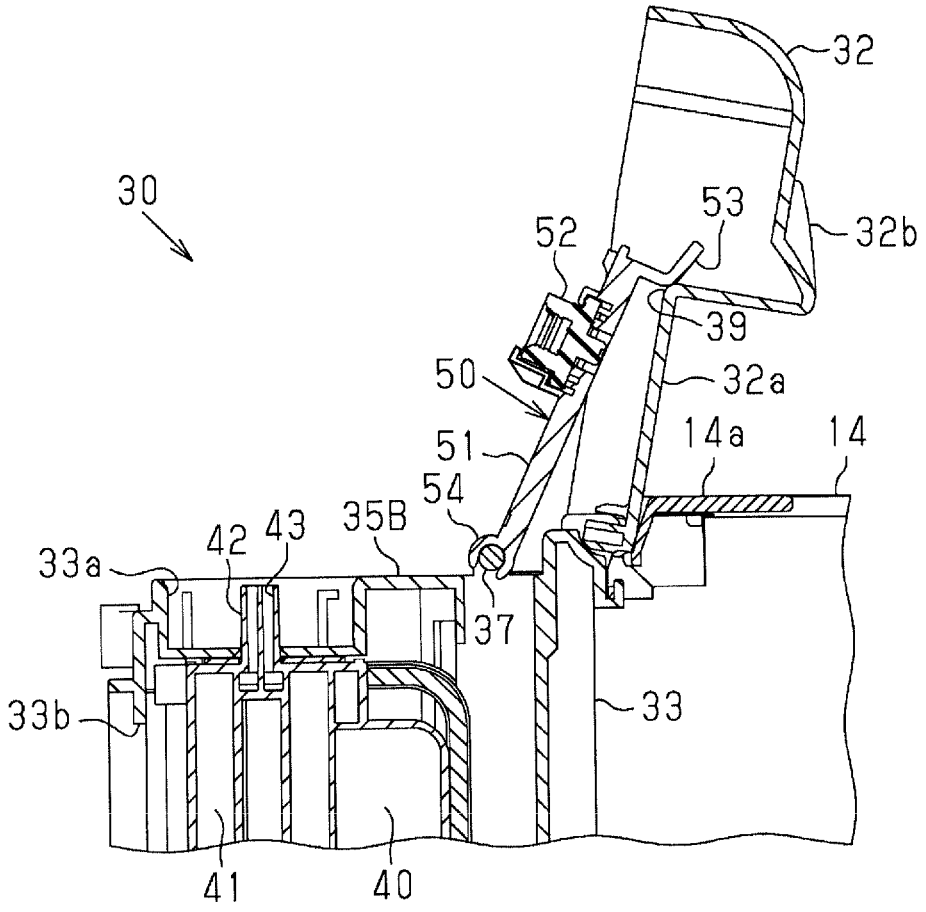
FIG. 17 is a side cross-sectional view showing a restricting structure at an open position of the plug member.

As shown in FIG. 17, it is preferable that the rotation range of the plug member 50 is restricted. In the example shown in FIG. 17, the rotation range of the plug member 50 is restricted by the plug member 50 coming into contact with the cover 32 at the open position. Inside the cover 32, a restriction portion 39 is provided, which restricts the rotation range of the holding member 51 by coming into contact with the holding member 51 when the plug member 50 is moved to the open position in a state where the cover 32 is at the open position. The cover 32 has a thin portion 32*a* having a small thickness on the side closer in the rotating radial direction to the connecting portion with the hinge portion 38, and a thick portion 32*b* on the far side. The bending portion positioned at the boundary between the thin portion 32*a* and the thick portion 32*b* inside the cover 32 functions as the restriction portion 39. The rotation range of the cover 32 is restricted, for example, by coming into contact with a restriction portion 14*a* of the casing 14, and the cover 32 is held at a predetermined open angle. When the plug member 50 is opened in a state where the cover 32 is at this open position, further movement of the plug member 50 in the opening direction is restricted by the holding member 51 coming into contact with the restriction portion 39, and thus the plug member 50 is held at the open position.

The opening angle at the open position, which is obtained using the closed position of the plug member 50 as the reference (0 degree), is set to a predetermined angle within a range that is greater than or equal to the minimum angle at which the plug member 50 does not tip over from the open position to the closed position by its own weight, and less than or equal to the maximum angle at which a gap (e.g., 5 mm or more) can be ensured, which is necessary for a user to hook his or her finger onto the tip portion of the gripping portion 53 in order to close the plug member 50 at the open position. It is preferable that the opening angle of the plug member 50 is a predetermined angle, for example, within a range of 95 to 170 degrees. In particular, in order to move reliably prevent the plug member 50 at the open position from tipping over to the closed position due to its own weight, it is preferable that the opening angle is 100 degrees or more. Also, as the opening angle of the plug member increases, the finger brought to the gripping portion 53 of the plug member 50 at the open position more easily touches the bottom portion of the plug body 52 when the plug member 50 is closed. In this respect, it is preferable that the opening angle of the plug member 50 is 150 degrees or less. Accordingly, it is more preferable that the opening angle of the plug member 50 is a predetermined angle within a range of 100 to 150 degrees. Note that in the example of FIG. 17, although the gripping portion 53 comes into contact with the restriction portion 39, other portions of the holding member 51 may also come into contact with the restriction portion 39. Also, the position of the restriction portion 39 in the cover 32 can also be appropriately changed according to the positional relationship with the plug member 50.

Figure 18:
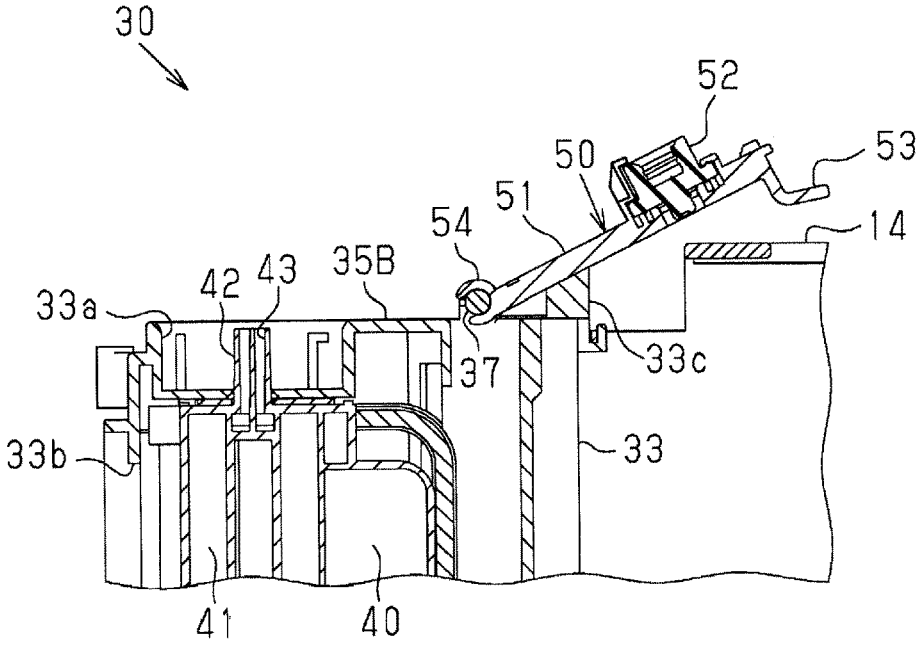
FIG. 18 is a side cross-section view showing the restricting structure at the open position of the plug member with no cover.

As shown in FIG. 18, a configuration without the cover 32 can also be implemented. As shown in FIG. 18, a restriction portion 33*c*, which restricts the rotation range of the holding member 51 by coming into contact with the holding member 51 when the plug member 50 is opened, is provided in the housing 33. It is preferable that the opening angle of the plug member 50 is, for example, in the range of 95 to 170 degrees, and more preferably in the range of 100 to 150 degrees. Note that, in the configuration including the cover 32, the rotation range of the plug member 50 may also be restricted due to the holding member 51 coming into contact with the restriction portion 33*c*.

Next, the operations of the liquid container unit 30 and the liquid ejecting apparatus 12 will be described.

In the liquid ejecting apparatus 12, a medium M fed from the medium storage cassette 19 is conveyed in the conveying direction Y, and an image and the like is printed on the medium M by the liquid ejecting portion 21 ejecting liquid to the medium M being conveyed. A control portion (not shown) of the liquid ejecting apparatus 12 manages the current amount of the liquid for each liquid container portion 40 by subtracting the amount of the liquid consumed from the previous amount of the liquid managed for each liquid container portion 40. If there is a liquid container portion 40 whose amount of the liquid is below a threshold value of the lower limit (e.g., near end), the control portion displays that fact in the display portion 17, and notifies the user of a request to inject liquid. The user injects the liquid to the liquid container portion 40 specified by the display content of the display portion 17.

In a case where liquid is injected to the liquid container portion 40, when the user first opens the image reading apparatus 13 and then opens the cover 32, the multiple plug members 50 provided for each liquid container portion 40 are exposed. In the example in which the covering member 65 of the holding member 51 of the plug member 50 is provided corresponding to the color of the liquid (FIG. 13), the plug member 50 corresponding to the liquid container portion 40 in which liquid is to be injected can be specified from, for example, the color indicated on the covering member 65, that is, at least one of the color that is same as the color of the liquid and the information indicating the color. Accordingly, the user can select and open the appropriate plug member 50 among the multiple plug members 50. At this time, because the user can open the plug member 50 by gripping the gripping portion 53 with his or her fingers, the user can easily open the plug member 50. In addition, because the gripping portion 53 is located at a position displaced to the one end side of the holding member 51 from the plug body 52, liquid on the plug body 52 is less likely to adhere to the fingers gripping the gripping portion 53.

Furthermore, because the plug body 52 is supported by the support portion 100 of the holding member 51 or the like, when the plug member 50 is opened, the plug body 52 does not come off of the holding member 51, and the plug body 52 moves together with the holding member 51 in a state of being held by the holding member 51.

After moving the plug member 50 to the open position at which the injection port 43 opens, the user can inject liquid to the liquid container portion 40 that is the appropriate injection destination from the injection port 43.

During the injecting of the liquid, the user visually checks the height of the liquid (liquid level) in the liquid container portion 40 from the outside of the liquid container unit 30, and injects the liquid until the upper limit is reached, for example. After finishing injecting the liquid, the user closes the plug member 50. At this time, the plug member 50 at the open position during injecting liquid is held at a predetermined opening angle (e.g., a predetermined angle in a range of 90 to 170 degrees) at which further movement is restricted by coming into contact with the restriction portion 39 or the restriction portion 33*c*, or is preferably held at a predetermined opening angle in a range of 95 to 150 degrees (refer to FIGS. 17 and 18). Accordingly, the fingers that are brought to the gripping portion 53 when the plug member 50 held at that opening angle are less likely to touch the bottom portion of the plug body 52. Also, when the plug member 50 is closed, liquid on the plug body 52 is less likely to adhere to the fingers and the like. Also, because the holding member 51 of the plug member 50 stands obliquely at a predetermined opening angle, it is easier to avoid a situation in which the user erroneously places his or her hand on the plug member 50 and breaks the plug member 50, compared with a case where the holding member 51 of the plug member 50 has been tipped over at an opening angle of about 180 degrees. In particular, in the configuration in which the rotation range of the plug member 50 is restricted by coming into contact with the restriction portion 39 inside the cover 32, the opening angle is easily set to a more preferable range of 100 to 150 degrees, and thus it is much less likely for liquid on the plug body 52 to adhere to the fingers and the like, and the frequency of breakage of the plug member 50 can be further reduced.

In addition, because the holding member 51 has a higher rigidity than the elastically deformable plug body 52 and is less likely to bend when the plug member 50 is opened, liquid on the plug body 52 is less likely to adhere to a finger and the like. For example, in a case where the rigidity of the holding member is less than or equal to the rigidity of the elastically deformable plug body, if the plug body 52 swings due to the holding member 51 bending when the plug member 50 is opened and closed, liquid on the plug body 52 easily adheres to the finger and the like of the user. However, in the present embodiment, the holding member 51 having a higher rigidity than the plug body 51 is less likely to bend when the plug member 50 is opened and closed, and the plug body 52 is less likely to swing, and thus liquid on the plug body 52 is less likely to adhere to the finger and the like, and the plug body 52 is easily positioned with respect to the injection port 43. In addition, if the plug body 52 is configured to have the guide surface 61*a* (refer to FIG. 8) the tip portion corresponding to the cylindrical portion 42, the plug body 52 can be tightly closed even if the plug body 52 is slightly shifted from the cylindrical portion 42. At this time, because the plug body 52 is made of an elastically deformable member, the injection port 43 can be tightly sealed with the plug body 52.

Furthermore, the plug member 50 is provided so as to be able to rotate with respect to the housing 33 or the liquid container portion 40 by the engagement of the shaft portion 37 and the engaging portion 54, and therefore little force is necessary for opening and closing the plug member 50 due to the principle of leverage when the other end of the holding member 51 (e.g., the gripping portion 53) is gripped and the plug member 50 is opened and closed. Accordingly, the plug member 50 can be easily opened with relatively little force.

Also, in the plug member 50 shown in FIGS. 7 to 12, the connection mechanism 60 in which the pair of protruding portions 62 (key portions) and the pair of groove portions 64 (key groove portions) are engaged is used to connect the holding member 51 and the plug body 52. Accordingly, when the plug body 52 is assembled on the holding member 51 at a manufacturing factory, the fitting portion 63 of the plug body 52 is fit into the through hole 51*a* of the holding member 51 and then the plug body 52 is axially rotated, and upon doing so, the pair of protruding portions 62 is locked in a state of being fit into the pair of groove portions holding 64. As a result, the holding member 51 and the plug body 52, which are made of different members having different rigidities, can be relatively easily connected. Therefore, the plug member 50 can be relatively easily manufactured.

According to the first embodiment, the following effects can be obtained.

1. The liquid container unit 30 for suppling liquid to the liquid ejecting portion 21 included in the liquid ejecting apparatus 12 includes the liquid container portions 40 for containing liquid, the housing 33 for arranging the liquid container portions 40, the injection port 43 for injecting liquid to the liquid container portions 40, and the plug member 50 for opening and closing the injection port 43. The plug member 50 includes the elastically deformable plug body 52 for covering the injection port 43, and the holding member 51, which has a higher rigidity than the plug body 52 and holds the plug body 52. Accordingly, when a user opens and closes the plug member 50 at a time of injecting liquid to the liquid container portion 40 or the like, it is possible to reduce the frequency with which liquid on the plug body 52 adheres to the user's finger and the like.

2. The holding member 51 includes the one end 511, the other end 512, and the side end 513 intersecting the one end 511 and the other end 512, and the gripping portion 53 for opening and closing the injection port 43 is provided at the one end 511. Accordingly, because a user can open and close the plug member 50 by gripping the gripping portion 53 with his or her fingers, the plug member 50 can be easily opened and closed, and it is possible to further reduce the frequency with which liquid on the plug body 52 adheres to the fingers and the like at the time of opening and closing.

3. In the holding member 51, the plug body 52 is arranged between the gripping portion 53 and the other end 512. Accordingly, when a user opens and closes the plug member 50, it is easier to prevent liquid on the plug body 52 from adhering to the user's finger and the like, by preventing the finger from accidentally touching a portion of the plug body 52 on the side sealing the injection port 43.

4. The liquid container unit 30 includes the multiple plug members 50 corresponding to each of the multiple liquid container portions 40. Each of the multiple plug members 50 has one plug body 52 for the corresponding liquid container portion 40. Because the plug members 50 are individually opened and closed for each liquid container portion 40, it is possible to further reduce the frequency with which liquid on the plug body 52 adheres to the user's finger and the like when opening and closing the plug member 50, compared with a configuration in which multiple plug bodies are integrally provided, and it is also possible to suppress the evaporation or volatilization of liquid from the liquid container portions 40 other than the liquid container portion 40 into which liquid is injected.

5. The liquid container unit 30 includes the shaft portion 37 for rotating the plug member 50, and the engaging portion 54 to be engaged with the shaft portion 37. One of the shaft portion 37 and the engaging portion 54 is provided in the housing 33, and the other is provided in the plug member 50. Accordingly, when the other end of the holding member 51 is gripped and the plug member 50 is opened and closed, the force necessary for opening and closing the plug member 50 can be reduced due to the principle of leverage.

6. The cover 32 or the housing 33 has the restriction portion 39 or the restriction portion 33*c* for restricting the rotation range of the holding member 51, due to the holding member 51 coming into contact with the restriction portion 39 or the restriction portion 33*c* upon being rotated in a direction of opening the injection port 43. For example, compared with a configuration in which the rotation range of the holding member 51 is not restricted and the plug member 50 is arranged at the open position in a tripped-over orientation rotated by about 180 degrees, when a user opens and closes the plug member 50, liquid on the plug body 52 is less likely to adhere to the user's finger and the like. Accordingly, it is possible to further reduce the frequency with which liquid on the plug body 52 adheres to the user's finger and the like. Also, the operation amount for opening and closing the plug member 50 can be relatively small, and thus liquid is easily injected. Furthermore, if a plug member is in an orientation of being inclined at the open position, there is a concern that a user will erroneously place his or her hand on the plug member and damage it. However, the plug member 50 of this example is held in an orientation of obliquely standing at the open position (e.g., an orientation in which the opening angle is in a range of 95 to 170 degrees), and thus there is little concern that the user will erroneously place his or her hand on the plug member 50. Accordingly, a situation in which the user erroneously damages the plug member 50 can be reduced.

7. In the holding member 51, the covering member 65 covers the opening on the upper side of the through hole 51*a* and is provided corresponding to the color of the liquid contained in the liquid container portion 40. Accordingly, because the covering member 65 functions as a cover for the through hole 51*a* of the holding member 51 and a color indication, the plug member 50 has good appearance, and it is possible to reduce an injection error in which a wrong color liquid is injected into the liquid container portion 40 because a user can confirm the color of liquid by seeing the covering member 65.

Also, the groove portion 66*a* of the cap 66 constituting the covering member 65 holds the fitting portion 63 and the retaining portion 63*a* by grasping them. Accordingly, the plug body 52 becomes less likely to come off of the holding member 51.

8. The liquid ejecting apparatus 12 includes the liquid container unit 30 and the liquid ejecting portion 21 for ejecting liquid supplied from the liquid container portions 40 in the liquid container unit 30. According to the liquid ejecting apparatus 12, if it is necessary to inject liquid into the liquid container portion 40 because the liquid ejecting portion 21 has consumed liquid, various effects that the liquid container unit 30 has can be similarly obtained.

9. The holding member 51 has the support portion 100, and the support surface 110 of the support portion 100 supports the end portion 69 of the plug body 52. Accordingly, the plug body 52 can be made less likely to come off of the holding member 51.

Second Embodiment

Next, a second embodiment will be described with reference to the drawings. Configurations similar to those of the first embodiment are denoted by the same reference numerals and description thereof is omitted. Hereinafter, regarding the second embodiment, a configuration different from that of the first embodiment, that is, the configuration of a plug member, will be described.

Figure 19:
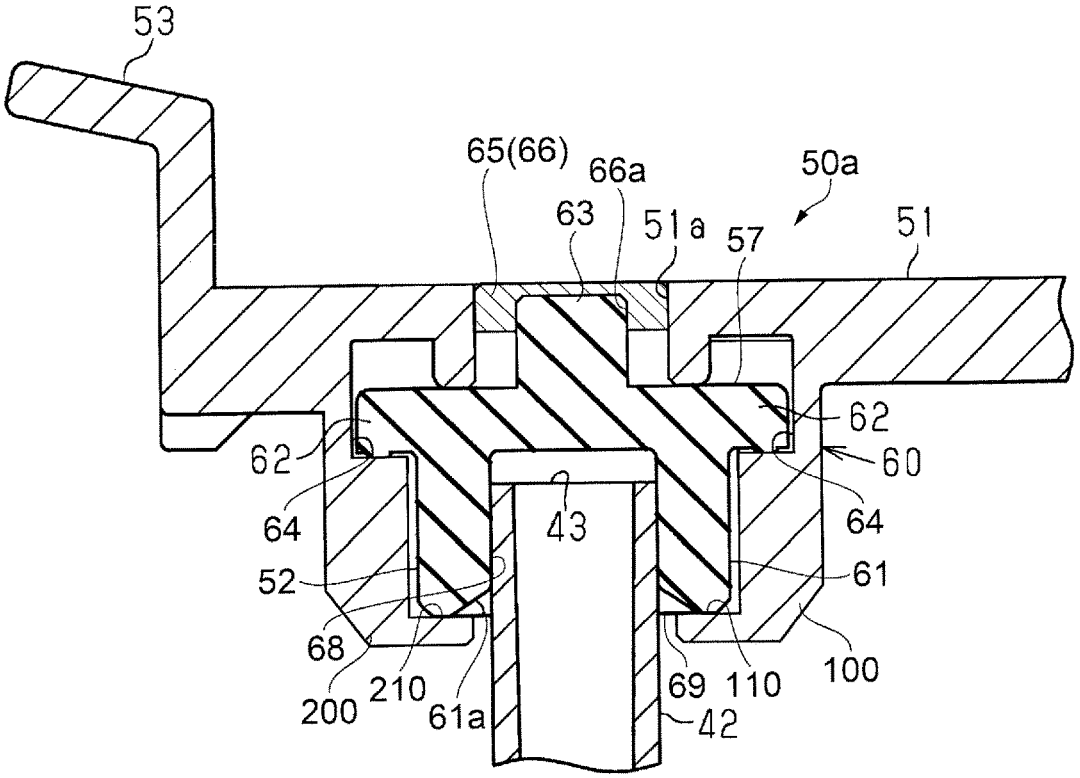
FIG. 19 is a partial side cross-sectional view showing a configuration of a plug member according to a second embodiment.

FIG. 19 is a partial side cross-sectional view showing a configuration of a plug member according to the present embodiment.

As shown in FIG. 19, a plug member 50*a* of the present embodiment has a first support portion 100 (similar to the support portion 100 according to the first embodiment) that is provided on an engaging portion 54 side of the end portion 69 of the plug body 52 and supports the end portion 69, and has a second support portion 200 that is provided on a side opposite to the engaging portion 54 of the end portion 69 of the plug body 52 and supports the end portion 69. The second support portion 200 has the same configuration as the first support portion 100, and has a substantially flat support surface 210 in contact with the end portion 69.

That is, in the present embodiment, the end portion 69 of the plug body 52 is supported by two locations, namely, the first support portion 100 and the second support portion 200.

The first support portion 100 and the second support portion 200 are arranged along the longitudinal direction of the holding member 51. Accordingly, because the end portion 69 of the plug body 52 is supported at the positions at which the first support portion 100 and the second support portion 200 face each other and the supporting force is evenly applied in the direction of gravity, the plug body 52 can be supported in a balanced manner.

Note that the configurations other than the above-mentioned configuration according to the plug member 50*a* are the same as those of the first embodiment. Note that in the present embodiment, similarly to the first embodiment, the cap 66 covering the through hole 51*a* may also be provided.

From the above, according to the present embodiment, the following effects can be obtained in addition to the effects of the above embodiment.

1. The plug member 50*a* includes the first support portion 100 and the second support portion 200, and each of the first support portion 100 and the second support portion 200 supports the end portion 69 of the plug body 52. Accordingly, the plug body 52 can be made even less likely to come off of the holding member 51 when the plug body 52 is removed from the injection port 43 by rotating the plug member 50.

Third Embodiment

Next, a third embodiment will be described with reference to the drawings. Configurations similar to those of the first embodiment are denoted by the same reference numerals and description thereof is omitted. Hereinafter, regarding the third embodiment, a configuration different from that of the first embodiment, that is, the configuration of a plug member, will be described.

Figure 20:
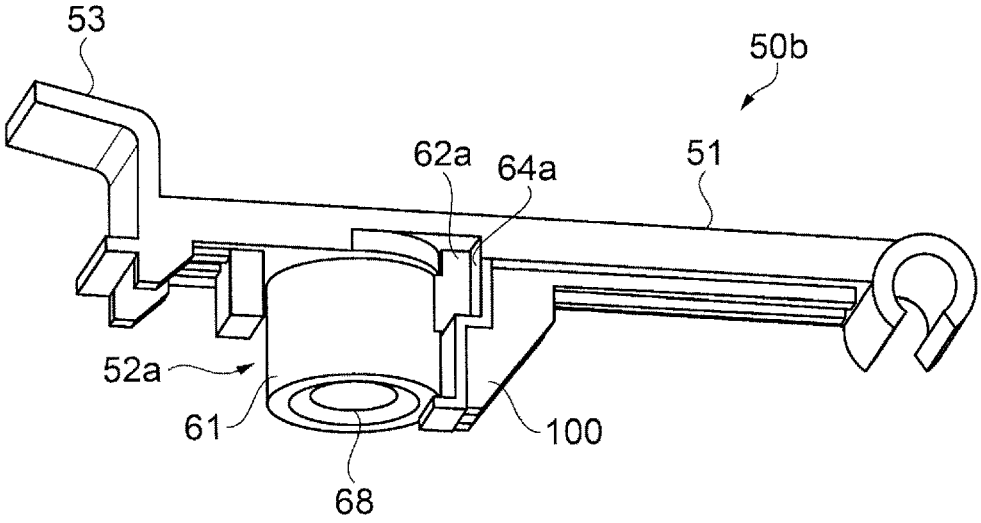
FIG. 20 is an external view showing a configuration of a plug member according to a third embodiment.

FIG. 20 is an external view showing a configuration of a plug member according to the present embodiment.

As shown in FIG. 20, a plug member 50*b* according to the present embodiment has a plug body 52*a* and the holding member 51 for holding the plug body 52*a*. Also, the plug member 50*b* includes the support portion 100 for supporting the end portion 69 of the plug body 52*a*. Note that, because the configuration of the support portion 100 is similar to that of the above embodiments, the description thereof is omitted.

The plug body 52*a* has a protruding portion 62*a* (key portion) protruding toward a radial direction side of the plug portion 61. The protruding portion 62*a* is formed so as to have a relatively large thickness. For example, the protruding portion 62*a* has a thickness that is about twice as thick as that of the protruding portion 62 according to the first embodiment.

A groove portion 64*a* (key groove portion) in which the protruding portion 62*a* can be put (inserted) is provided in the periphery of the through hole 51*a* on the underside surface of the holding member 51. The groove portion 64*a* extends in an arc shape concentric with the through hole 51*a*, and has a groove path in which one end is open and the other end is closed. A locking portion (not shown) for locking the protruding portion 62*a* and the groove portion 64*a* when the protruding portion 62*a* is completely inserted into the groove portion 64*a* is provided.

Note that the configurations other than the above-mentioned configuration according to the plug member 50*b* are the same as those of the first embodiment. Also, in the present embodiment, similar to the first embodiment, the cap 66 for covering the through hole 51*a* may also be provided.

Also, in the present embodiment, the number of protruding portions 62*a* is set to one, but there is no limitation to this. For example, the number of protruding portions 62*a* may be multiple (pair).

In addition, in another embodiment, the number of protruding portion 62 may be multiple (pair), or may be one.

According to the above description, with the present embodiment, the following effects can be obtained in addition to the effects of the above embodiments.

1. The plug member 50*b* has the support portion 100 and the protruding portion 62*a* has a relatively large thickness, and thus deformation of the protruding portion 62*a* is reduced, and the area of contact with the groove portion 64*a* increases because the surface area of the protruding portion 62*a* is larger. Accordingly, the friction force between the protruding portion 62*a* and the groove portion 64*a* increases, and thus the plug body 52 can be made less likely to come off of the holding member 51.

Fourth Embodiment

Next, a fourth embodiment will be described with reference to the drawings. Configurations similar to those of the first embodiment are denoted by the same reference numerals and description thereof is omitted. Hereinafter, regarding the fourth embodiment, a configuration different from that of the first embodiment, that is, the configuration of a plug member, will be described.

Figure 21:
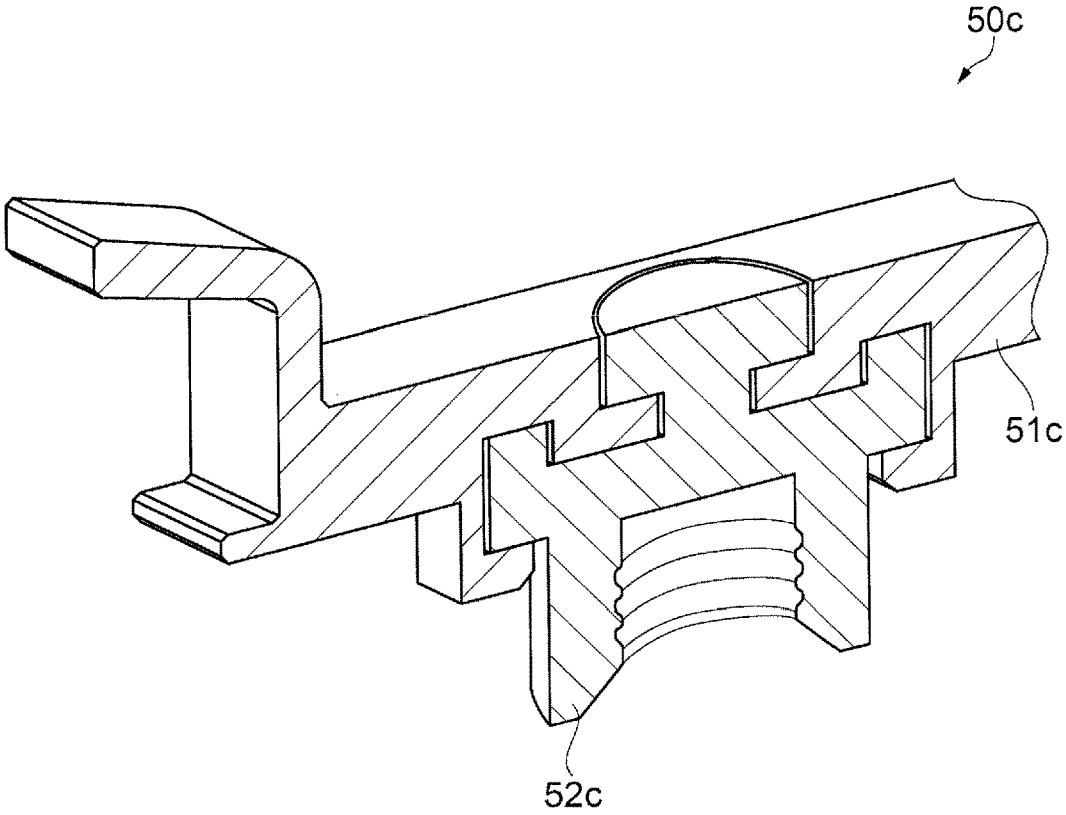
FIG. 21 is a partial side cross-sectional view showing a configuration of a plug member according to a fourth embodiment.

FIG. 21 is a partial side cross-section view showing a configuration of a plug member according to the present embodiment.

As shown in FIG. 21, a plug member 50*c* of the present embodiment has a plug body 52*c* and a holding member 51*c*. In the plug member 50*c* of the present embodiment, the plug body 52*c* and the holding member 51*c* are integrally molded.

Specifically, the plug member 50*c* is molded using an injection molding apparatus capable of injecting each of the materials of the plug body 52*c* and the holding member 51*c* at the same time. Specifically, the plug body 52*c* is molded using a flexible material, and the holding member 51*c* is molded using a non-flexible material. Note that, in this case, two-color molding may also be performed. Specifically, the plug body 52*c* and the holding member 51*c* are molded so as to have different colors. The plug body 52*c* is formed, for example, with the same color as the liquid contained in the corresponding liquid container portion 40. In this manner, a user can recognize the color of the liquid from the color indicated by the plug body 52*c*, and thus it is possible to make it less likely to mistake the type (color) of liquid to be injected into the liquid container portion 40.

Note that the whole of the plug member 50*c* may be formed with the same color as the liquid contained in the corresponding liquid container portion 40.

According to the above description, with the present embodiment, the following effects can be obtained in addition to the effects of the above embodiments.

1. Because the plug body 52*c* of the plug member 50*c* and the holding member 51*c* are formed through integral molding, the adhesive strength between the plug body 52*c* and the holding member 51*c* can be increased. Accordingly, the plug body 52 can be made even less likely to come off of the holding member 51.

At least a part of the configurations included in the above embodiments may also be implemented in the variations shown below. Also, the configurations included in the above embodiments and the following variations may be suitably combined, or the configurations included in the following variations may be suitably combined.

In the first to third embodiments, the support portion 100 (the first support portion 100 and the second support portion 200) has the configuration for supporting a part of the end portion 69 of the plug portion 61, but there is no limitation to this. The support portion may have a configuration for supporting the whole of the end portion 69 (entire periphery) of the plug portion 61. In this manner, the supporting force of the plug body further increases, and thus the plug body can be made less likely to come off of the holding member.

It is sufficient that one of the shaft portion for rotating the plug member and the engaging portion for engaging with the shaft portion is provided in the liquid container portion 40 or the housing 33, and the other portion is provided in the plug member 50. Also, a configuration is possible in which the shaft portion is provided in the other end of the plug member 50, and the engaging portion engaging with the shaft portion is provided in the housing 33 or the liquid container portion 40.

The housing may be integrated with the casing of the liquid ejecting apparatus.

The whole of the plug body 52 may also be fit into the through hole 51*a* of the holding member 51.

In the first to third embodiments, the restriction portion for restricting the rotation range of the plug body 52 or 52*a* by coming into contact with the holding member 51 may also be provided in the casing 14.

In the first to fourth embodiments, a shaft portion may be cylindrical, and may be a shaft-like engaging portion that can be inserted into the cylinder at both end portions of the shaft portion. Also, the engaging portion may also be a recessed or cylindrical engaging portion capable of engaging with the shaft portion at both end portions thereof. Also, the engaging portion of the holding member is a cylindrical portion, and both of the cylindrical portion and the shaft portion may be engaged with each other by inserting the shaft portion into the cylindrical portion. Also with these configurations, the holding member 51 can be held in a rotatable state.

A configuration is possible in which the holding member 51 can rotate in the surface parallel to the opening surface of the injection port 43.

The injection port 43 may be provided in any surface of the liquid container portion 40, and for example, may be provided in the front surface of the liquid container portion 40. In this case, the plug member 50 may have a configuration in which the holding member 51 is provided rotatably around the lower end (the other end), or the holding member 51 is held slidably in the vertical direction (longitudinal direction).

It is sufficient that one or multiple liquid container portions 40 can be arranged in a predetermined orientation in the housing 33. For example, the housing 33 may be a shallow housing covering only the lower part (e.g., a lower half part in the height direction) of the liquid container portion 40, or may be a frame-shaped housing with open front, rear, left and right surface portions. Also, the housing 33 may have a configuration having no window portion 33*b*.

In each embodiment, the cover 32 may be omitted. Also, only one liquid container portion 40 may also be provided.

The liquid ejecting apparatus 12 is not limited to a configuration constituting a part of the multi-function printer 11, but may be a printing apparatus dedicated to printing.

An example of liquid that the liquid ejecting portion 21 ejects is not limited to ink, but may be, for example, a liquid material in which particles of a functional material are dispersed or mixed in liquid. For example, a liquid material may be used, which contains dispersed or dissolved materials such as an electrode material and a coloring material (pixel material) used for manufacturing a liquid crystal display, an EL (electroluminescence) display, and a surface emitting display. That is, the liquid ejecting apparatus may be an apparatus for ejecting dispersed or dissolved materials such as an electrode material and a coloring material used for manufacturing the above mentioned various displays, an apparatus for ejecting ultraviolet curable resin liquid, or the like, or may be an apparatus for ejecting liquid containing a functional material.

An example of a medium M on which the liquid ejecting apparatus ejects liquid is not limited to paper, but may be a plastic film or sheet, a thin plate, metal foil, a laminate film, furthermore, may be a circuit board and the like, or fabric used for a textile printing apparatus. Also, a medium M may be clothing having any shape such as a T-shirt, or may be a three-dimensional object having any shape such as tableware or stationery.

The liquid ejecting apparatus may also be a liquid ejecting apparatus for three dimensions that forms a three-dimensional object by ejecting resin liquid with a liquid ejecting method (e.g., an ink-jet method).

This application claims the benefit of foreign priority to Japanese Patent Application No. JP2017-208901, filed Oct. 30, 2017, which is incorporated by reference in its entirety.

What is claimed is:

1. A plug member configured to cover a liquid injection port to inject liquid to a liquid container portion of a liquid ejecting apparatus, the plug member comprising:

an elastically deformable plug body; and a holding member that has a higher rigidity than the plug body and holds the plug body, wherein the plug body includes a lid part configured to cover the liquid injection port, and a barrel part extending from the lid part to the liquid container portion, the barrel part includes an end portion in which an opening is formed on a side opposite to the lid part, and the holding member includes an engaging portion engageable with a shaft portion to rotate the holding member, and a support portion that is provided on an engaging portion side of the end portion and supports the end portion.

2. The plug member according to claim 1, wherein letting the support portion be a first support portion, the plug member further includes a second support portion supporting the end portion, on a side opposite to the engaging portion side of the end portion.

3. A liquid container unit, comprising;

the plug member according to claim 1, a liquid container portion, a liquid injection port provided in a surface of the liquid container portion, and a housing that arranges the liquid container portion and includes a shaft portion to rotate the holding member.

4. A liquid container unit, comprising;

the plug member according to claim 2;

a liquid container portion, a liquid injection port provided in a surface of the liquid container portion, and a housing that arranges the liquid container portion and includes a shaft portion to rotate the holding member.

5. The plug member according to claim 1, wherein the engaging portion comprises a curved opening configured to receive the shaft portion.

6. The plug member according to claim 1, wherein the support portion comprises a substantially flat support surface that contacts and supports the end portion of the barrel part.

7. The plug member according to claim 6, wherein the substantially flat support surface is a first support surface, and the support member comprises a second support surface that contacts and supports the lid part of the plug body.

* * * * *